US010801506B2

(12) United States Patent
Shoji

(10) Patent No.: US 10,801,506 B2
(45) Date of Patent: Oct. 13, 2020

(54) FIXING BOLT FOR STATIONARY MEMBER, AND CENTRIFUGAL COMPRESSOR

(71) Applicant: MITSUBISHI HEAVY INDUSTRIES COMPRESSOR CORPORATION, Tokyo (JP)

(72) Inventor: Yoshiaki Shoji, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 276 days.

(21) Appl. No.: 15/765,625

(22) PCT Filed: Nov. 27, 2015

(86) PCT No.: PCT/JP2015/005927
§ 371 (c)(1),
(2) Date: Apr. 3, 2018

(87) PCT Pub. No.: WO2017/090073
PCT Pub. Date: Jun. 1, 2017

(65) Prior Publication Data

US 2018/0306194 A1 Oct. 25, 2018

(51) Int. Cl.
*F04D 17/12* (2006.01)
*F04D 29/62* (2006.01)
*F04D 29/42* (2006.01)

(52) U.S. Cl.
CPC ..... *F04D 17/125* (2013.01); *F04D 29/4206* (2013.01); *F04D 29/624* (2013.01)

(58) Field of Classification Search
CPC ..... F04D 1/063; F04D 1/066; F04D 17/122; F04D 17/125; F04D 29/624
See application file for complete search history.

(56) References Cited

U.S. PATENT DOCUMENTS 890,662 A * 6/1908 Lager ..... F04D 1/063 415/199.2
1,516,110 A * 11/1924 Mackley ..... F04D 1/063 415/187

(Continued)

FOREIGN PATENT DOCUMENTS

CH 267487 A 3/1950
EP 2127931 A2 12/2009

(Continued)

OTHER PUBLICATIONS

International Preliminary Report on Patentability issued in corresponding International Application No. PCT/JP2015/005927 dated May 29, 2018 (7 pages).

(Continued)

*Primary Examiner* — Kayla Mccaffrey
(74) *Attorney, Agent, or Firm* — Osha Liang LLP

(57) ABSTRACT

A fixing bolt for a stationary member, the bolt extending through and fixing a plurality of stationary members in a multistage centrifugal compressor, includes a head portion, a columnar portion connected to the head portion, and a threaded portion connected to the columnar portion. The columnar portion includes one or more large diameter parts and a plurality of small diameter parts, the one or more large diameter parts each corresponding to a position of an antinode of a primary vibration mode of the fixing bolt for the stationary member, or to the position of the antinode of the primary vibration mode and positions of antinodes of a secondary vibration mode of the fixing bolt for the stationary member, and each of the plurality of small diameter parts having a diameter smaller than each of the large diameter parts.

8 Claims, 5 Drawing Sheets

(56) References Cited

U.S. PATENT DOCUMENTS

| | | | | | |
|---|---|---|---|---|---|
| 2,514,865 | A | * | 7/1950 | Hornschuch | F04D 29/106 415/108 |
| 2,650,017 | A | | 8/1953 | Pedersen et al. | |
| 3,051,090 | A | * | 8/1962 | Zumbusch | F04D 1/063 415/199.1 |
| 3,070,348 | A | | 12/1962 | Vogel | |
| 3,118,386 | A | * | 1/1964 | Carswell | F04D 1/063 137/412 |
| 5,087,172 | A | * | 2/1992 | Ferri | F04D 29/122 277/320 |
| 2011/0052371 | A1 | | 3/2011 | Aschenbruck et al. | |

FOREIGN PATENT DOCUMENTS

| | | | |
|---|---|---|---|
| GB | 933185 | A | 8/1963 |
| JP | S63-173508 | U | 11/1988 |
| JP | H06-76699 | U | 10/1994 |
| JP | H06-083988 | U | 12/1994 |
| JP | H10-299567 | A | 11/1998 |
| JP | 2009-286354 | A | 12/2009 |
| JP | 2010-223292 | A | 10/2010 |
| WO | 2009/100748 | A1 | 8/2009 |
| WO | 2014/171209 | A1 | 10/2014 |

OTHER PUBLICATIONS

International Search Report issued in corresponding International Application No. PCT/JP2015/005927 dated Mar. 1, 2016 (2 pages).
Extended European Search Report issued in corresponding European Application No. 15909192.5 dated Sep. 17, 2018 (10 pages).

* cited by examiner

FIXING BOLT FOR STATIONARY MEMBER, AND CENTRIFUGAL COMPRESSOR

TECHNICAL FIELD

One or more embodiments of the present invention relate to a bolt for fixing a stationary member of a centrifugal compressor.

BACKGROUND ART

For example, in a multistage centrifugal compressor 100 of a vertical division type disclosed in Patent Literature 1, as illustrated in FIG. 5, a plurality of impellers 102, in this case, three impellers 102 are fixed in a vertical row to a rotary shaft 101, and partition plates 103 and 103 that define an interstage flow path 103*d* are provided between adjacent impellers 102. The partition plates 103 and 103 are independent of each other and each have a disk shape. The interstage flow path 103*d* runs from an outlet of the impeller 102 of the preceding stage toward an outer diameter direction, is then folded toward an inner diameter direction, and is connected to an inlet of the impeller 102 of the subsequent stage. Therefore, the interstage flow path 103*d* has a shape guiding a fluid with reduced compression loss.

An inlet wall 105 including a suction port 105*i* is provided on upstream of the impeller 102 of a first stage, and an outlet wall 106 including a discharge port 106*o* is provided on downstream of the impeller 102 of a third stage. Vehicle compartment covers 107 and 107 that support the rotary shaft 101 are provided outside the inlet wall 105 and the outlet wall 106.

For example, holes for four assembling through bolts 108 and holes for thirty fixing bolts 109 are communicably provided on an outer periphery of each of the vehicle compartment cover 107 on left side in the drawing, the inlet wall 105, the partition plates 103 and 103, the outlet wall 106, and the vehicle compartment cover 107 on right side in the drawing. The through bolts 108 and the fixing bolts 109 extend through the corresponding holes and are rigidly fastened.

A vehicle compartment 104 is provided and assembled on the outside of the partition plate 103, the inlet wall 105, the outlet wall 106, and the vehicle compartment cover 107, so as to surround and integrate these stationary members.

CITATION LIST

Patent Literature

Patent Literature 1: Japanese Utility Model Laid-Open No. 6-83988

SUMMARY OF INVENTION

According to the above-described centrifugal compressor 100 disclosed in Patent Literature 1, outer peripheral portions of the respective partition plates 103 and 103 are fixed and supported by the fixing bolts 109. Therefore, it is said that deflection of each of the partition plates 103 and 103 is suppressed small, and deformation of the flow path, variation of a gap with the impeller, and the like become small, which makes it possible to suppress deterioration of aerodynamic performance. In addition, according to the centrifugal compressor 100 disclosed in Patent Literature 1, each of the partition plates 103 and 103 is made small to shorten the rotary shaft 101, which is advantageous in rotational vibration.

In the centrifugal compressor 100, however, vibration still occurs due to rotation of the rotary shaft 101 and the impellers 102. Incidentally, the vibration is resultant vibration of vibration caused by rotation itself of the rotary shaft 101 and the impellers 102 and vibration caused by fluid compression associated with the rotation of the rotary shaft 101 and the impellers 102.

The members configuring the centrifugal compressor 100 are required to have vibration resistance to the vibration of the centrifugal compressor 100. Among the members, the through bolt 108 and the fixing bolt 109 are lower in strength than the other members. Therefore, it is demanded to secure reliability preventing damage such as crack and fracture even when the through bolt 108 and the fixing bolt 109 are used for a long term.

Accordingly, one or more embodiments of the present invention improve vibration resistance of the fixing bolt for the stationary member used in the centrifugal compressor.

In addition, one or more embodiments of the present invention provide the centrifugal compressor in which the stationary member is fastened with use of such a fixing bolt for the stationary member.

According to one or more embodiments of the present invention, there is provided a fixing bolt for a stationary member that extends through and fixes a plurality of stationary members in a multistage centrifugal compressor, and the fixing bolt for the stationary member includes a head portion, a columnar portion connected to the head portion, and a threaded portion connected to the columnar portion.

The columnar portion according to one or more embodiments of the present invention includes one or more large diameter parts and a plurality of small diameter parts. The one or more large diameter parts correspond to a position of an antinode of a primary vibration mode of the fixing bolt for the stationary member, or to the position of the antinode of the primary vibration mode and positions of antinodes of a secondary vibration mode. Each of the plurality of small diameter parts has a diameter smaller than each of the large diameter parts.

According to the fixing bolt for the stationary member of one or more embodiments of the present invention, since the large diameter parts corresponding to the antinodes of the vibration mode and the small diameter parts, strength of each of which is suppressed low, are provided, it is possible to reduce deflection of the columnar portion, and to suppress stress concentration to a boundary between the head portion and the columnar portion and to a boundary between the columnar portion and the threaded portion. This improves vibration resistance of the fixing bolt for the stationary member of one or more embodiments of the present invention.

Combinations of a plurality of large diameter parts and a plurality of small diameter parts in the columnar portion of one or more embodiments of the present invention are encompassed.

A first form of the columnar portion includes a first large diameter part and first small diameter parts that are respectively disposed on both sides of the first large diameter part, and the first large diameter part corresponds to the antinode of the primary vibration mode.

In addition, a second form of the columnar portion further includes second large diameter parts that are respectively connected to the first small diameter parts, in addition to the first form, and the second large diameter parts correspond to the antinodes of the secondary vibration mode.

Further, a third form of the columnar portion further includes second small diameter parts that are respectively connected to the second large diameter parts, in addition to the second form, and at least one of the second small diameter parts is connected to the head portion or the threaded portion.

Furthermore, a fourth form of the columnar portion further includes second small diameter parts that are respectively connected to the second large diameter parts, and at least one third large diameter part that is connected to at least one of the second small diameter parts, in addition to the second form. The at least one third large diameter part is connected to the head portion or the threaded portion.

When a restriction pin that stops displacement of the fixing bolt in an axial direction and a circumferential direction abuts on the first large diameter part to restrict the first large diameter part in a state where the fixing bolt of one or more embodiments of the present invention is used for fastening, the abutted portion becomes a node of the vibration mode. This makes it possible to suppress both of the primary vibration mode and the secondary vibration mode between the head portion and the first large diameter part and between the threaded portion and the first large diameter part, respectively.

In addition, the columnar portion according to one or more embodiments of the present invention includes one or more vibration dampers on an outer periphery.

In this case, at least one of the first large diameter part and the first small diameter part may include one or more vibration dampers.

Further, at least one of the second large diameter parts may include one or more vibration dampers. Moreover, at least one of the second small diameter parts may include one or more vibration dampers.

According to the fixing bolt for the stationary member of the present invention, since the large diameter parts corresponding to the antinodes of the vibration mode and the small diameter parts, strength of each of which is suppressed low, are provided, it is possible to reduce deflection of the columnar portion, and to suppress stress concentration to the boundary between the head portion and the columnar portion and to the boundary between the columnar portion and the threaded portion. This improves vibration resistance of the fixing bolt for the stationary member of the present invention.

BRIEF DESCRIPTION OF DRAWINGS

FIGS. 1A and 1B illustrate a schematic configuration of a centrifugal compressor according to one or more embodiments of the present invention, in which FIG. 1A is a half vertical cross-sectional view, and FIG. 1B is a half cross-sectional view of a partition plate.

FIGS. 2A to 2C are partial vertical cross-sectional views each illustrating a fixing bolt that fastens a stationary member of the centrifugal compressor of FIGS. 1A and 1B, in which FIG. 2A illustrates a basic form, and FIGS. 2B and 2C each illustrate a form in which vibration dampers are added to the form of FIG. 2A.

FIGS. 3A to 3C are partial vertical cross-sectional views each illustrating another fixing bolt that fastens the stationary member of the centrifugal compressor of FIGS. 1A and 1B, in which FIG. 3A illustrates a basic form, and FIGS. 3B and 3C each illustrate a form in which vibration dampers are added to the form of FIG. 3A.

FIGS. 5A and 5B illustrate a centrifugal compressor disclosed in Patent Literature 1, in which FIG. 5A is a half vertical cross-sectional view, and FIG. 5B is a half cross-sectional view of a partition plate.

DETAILED DESCRIPTION

A multistage centrifugal compressor according to one or more embodiments of the present invention is described below with reference to FIG. 1 to FIG. 4C.

Figure 5A:
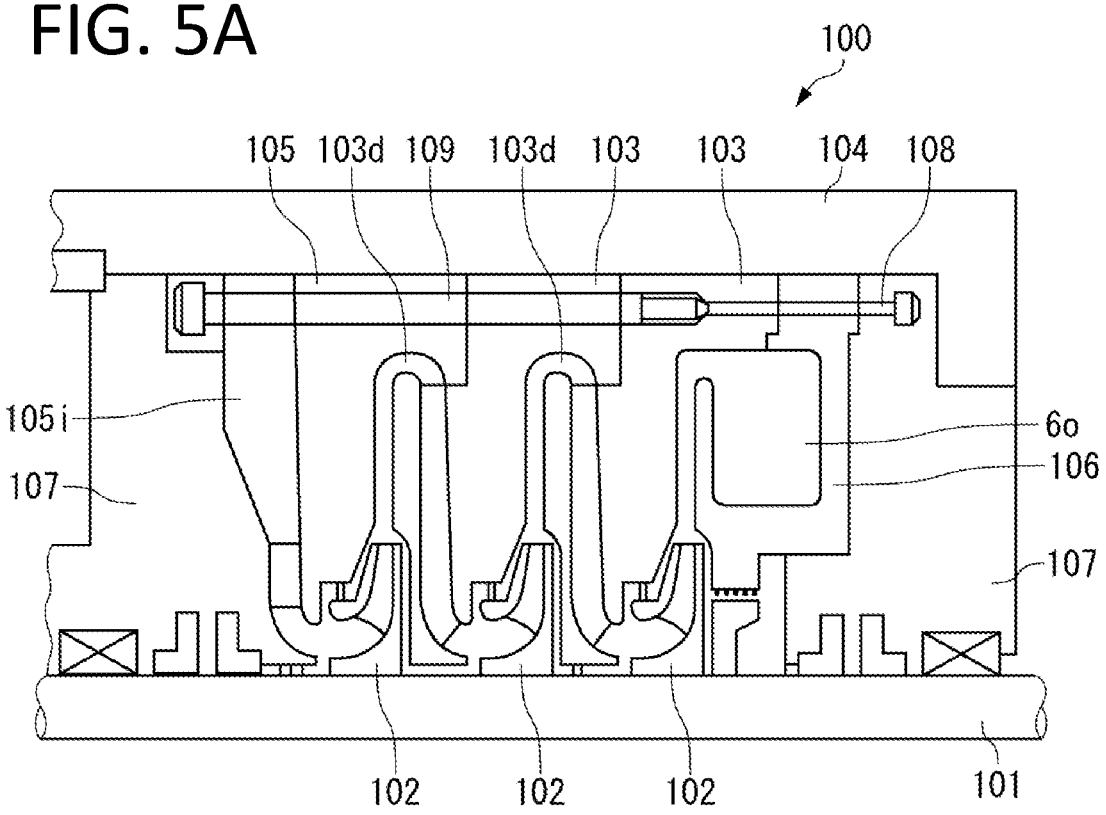
Figure 5B:
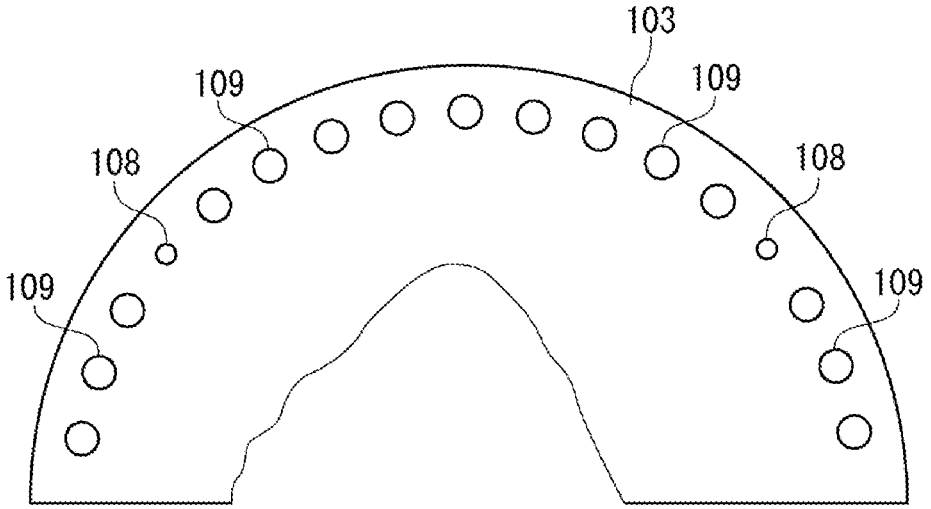

A multistage centrifugal compressor 10 according to one or more embodiments has the configuration same as the configuration of the centrifugal compressor 100 described with use of FIG. 5 except that a configuration of a fixing bolt 9 extending through and fixing a stationary member is different from that of the centrifugal compressor 100. Accordingly, in the following, operation of the centrifugal compressor 10 and differences with the centrifugal compressor 100 are mainly described. Note that a rotary shaft 1 of FIG. 1 corresponds to the rotary shaft 101 of FIG. 5, and reference numerals of other members have similar correspondence relationship.

Figure 1A:
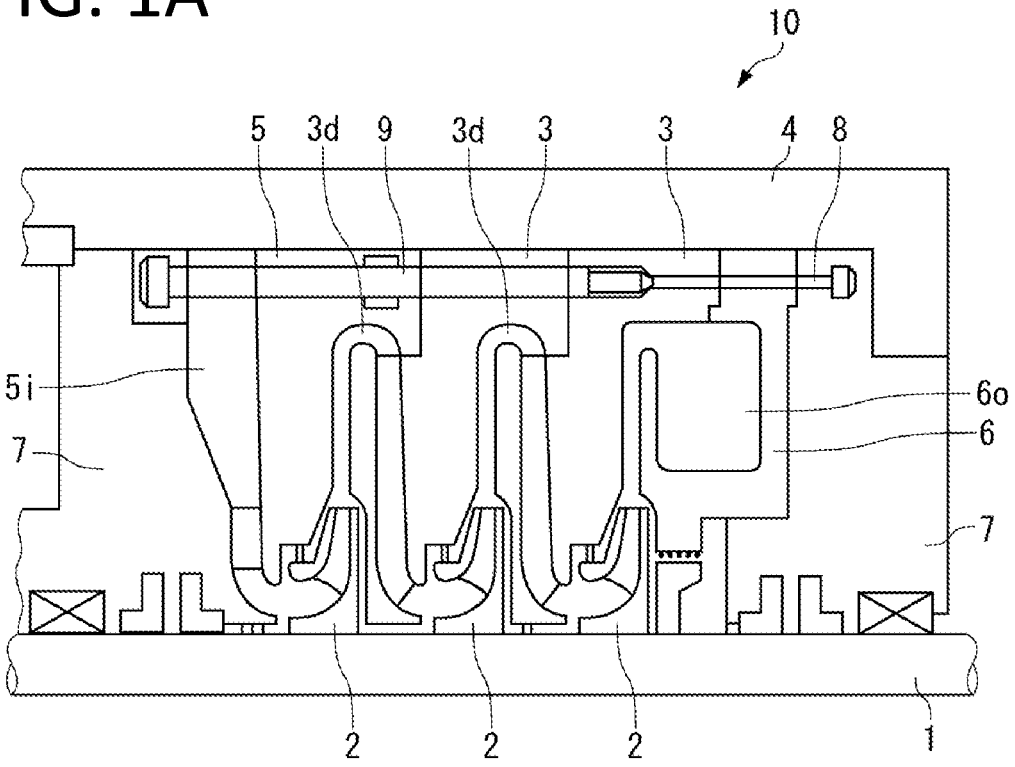
Figure 1B:
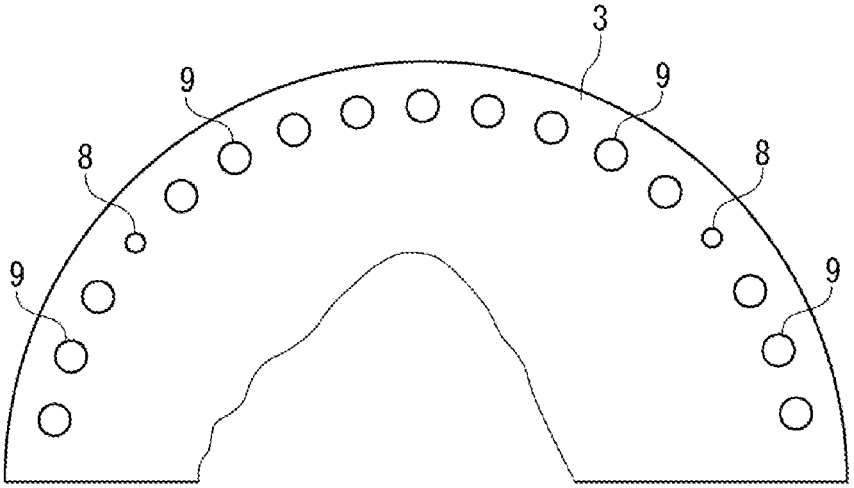

The operation of the centrifugal compressor 10 illustrated in FIG. 1 is described below.

When the rotary shaft 1 is driven by an unillustrated driver such as an electric motor coupled to the rotary shaft 1 and the rotary shaft 1 accordingly rotates at high speed, each of impellers 2 fixed to the rotary shaft 1 rotates together with the rotary shaft 1, and sucks a fluid such as gas from an inlet of each of the impellers 2 and discharges the fluid from an outlet. In other words, the fluid that has been sucked into the impeller 2 in a first stage through a suction port 5*i* and then discharged flows through a first interstage flow path 3*d* to the impeller 2 in a second stage. At this time, pressure of the fluid flowing through the first interstage flow path 3*d* is higher than pressure of the fluid in the suction port 5*i* by an amount of energy provided by the impeller 2 in the first stage. Likewise, pressure of the fluid that has passed through the impellers 2 in the second stage and a third stage respectively becomes higher than the previous pressure. Note that, in a case of compressing gas having a large molecular weight, such as carbon dioxide and butadiene, energy larger than energy of light gas is sucked to increase pressure difference even at the same rotation number by the same impellers. The fluid, the pressure of which has been successively increased, is discharged through a discharge port 6*o*. As described above, the fluid pressure becomes higher in order from the suction port 5*i* on left side in the drawing to the discharge port 6*o* on right side.

When the centrifugal compressor 10 is continuously operated, vibration is repeatedly applied to a through bolt 8 and the fixing bolt 9. When the through bolt 8 and the fixing bolt 9 are inserted into corresponding bolt insertion holes with no gap, deflection or runout (hereinafter, collectively referred to as deflection) caused by the vibration does not occur on the through bolt 8 and the fixing bolt 9 even if receiving the vibration. In consideration of machining accuracy, however, it is necessary to inevitably provide a gap around the through bolt 8 and the fixing bolt 9. Accordingly, deflection caused by the vibration occurs on the through bolt 8 and the fixing bolt 9, and damage such as crack and fracture caused by fatigue may occur on the through bolt 8 and the fixing bolt 9. In particular, the fixing bolt 9 is easily damaged because the fixing bolt 9 is longer in size than the through bolt 8. The fixing bolt 9 according to one or more embodiments, however, has a structure that considerably reduces occurrence of damage as described below.

Figure 2A:
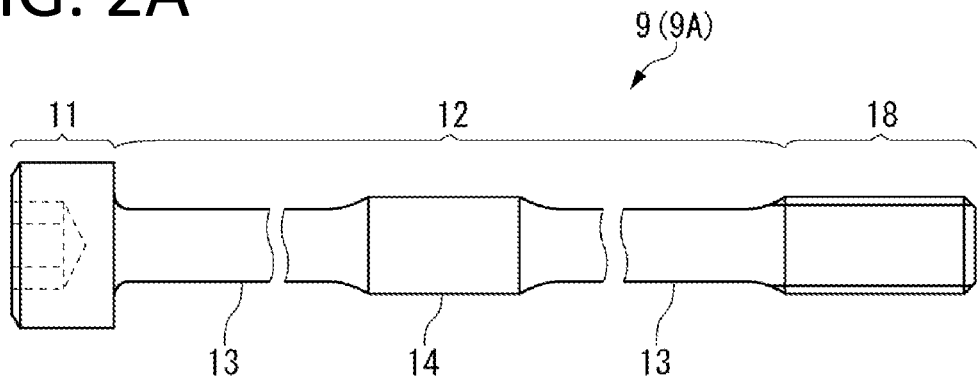

As illustrated in FIG. 2A, the fixing bolt 9 includes a head portion 11, a columnar portion 12 connected to the head portion 11, and a threaded portion 18 connected to the columnar portion 12. A fixing bolt 9A is integrally fabricated by stainless steel or other metal material. In the fixing bolt 9A, the columnar portion 12 is longer than the threaded portion 18, and the form of the elongated columnar portion 12 has the feature of the fixing bolt 9A. In other words, the columnar portion 12 has the form in which a first small diameter part 13, a first large diameter part 14, and the first small diameter part 13 are arranged in order from the head portion 11 side, and the first small diameter parts 13 are respectively disposed on both sides of the first large diameter part 14. The first large diameter part 14 has a large diameter at a center part. The first small diameter part 13 has a small diameter and is constricted. The first small diameter part 13 has the diameter smaller than a diameter at a top of a thread of the threaded portion 18. The columnar portion 12 includes the first small diameter parts 13 and 13 and the first large diameter part 14 for the following reason.

According to the study by the inventors, when the fixing bolt 9A repeatedly receives vibration, a boundary between the head portion 11 and the columnar portion 12 and a boundary between the columnar portion 12 and the threaded portion 18 are easily damaged. The easily-damaged state is not eliminated only by increasing the diameter of the columnar portion 12. In other words, the diameter is largely varied at the boundary between the head portion 11 and the columnar portion 12, which easily causes stress concentration. In addition, at the boundary between the columnar portion 12 and the threaded portion 18, the threaded portion 18 engages with an unillustrated thread groove and motion thereof is restrained, whereas slight deflection may occur on the columnar portion 12. Therefore, the boundary between the columnar portion 12 and the threaded portion 18 is also easily damaged due to stress concentration.

Therefore, the fixing bolt 9A includes the first small diameter part 13 that has relatively low strength, at a part connected to the head portion 11 and at a part connected to the threaded portion 18. In other words, causing elastic deformation at the first small diameter part 13 having low strength suppresses the degree of stress concentration, which makes a structure be hardly damaged even if the stress concentration occurs at the boundary between the head portion 11 and the columnar portion 12 and the boundary between the columnar portion 12 and the threaded portion 18.

When the columnar portion 12 is wholly made small in diameter, however, a degree of deflection of the columnar portion 12 is increased. Therefore, a gap between the fixing bolt 9A and a wall surface defining the bolt insertion hole (not illustrated) is made partially small by providing the first large diameter part 14 in the fixing bolt 9A, which leads to reduced deflection.

Figure 4A:
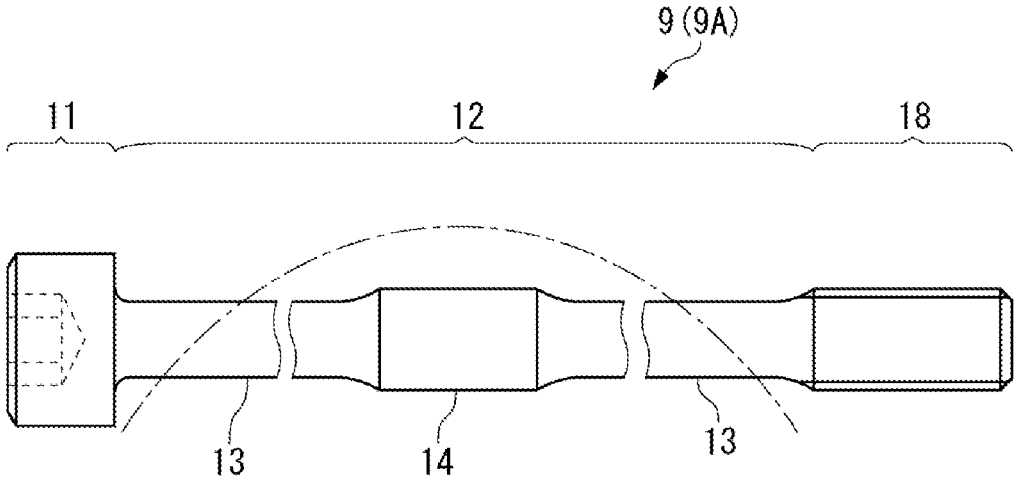
FIG. 4A is a diagrams illustrating the fixing bolt of FIG. 2A and a primary vibration mode by being superposed on each other.

The first large diameter part 14 is provided at a position that includes an antinode of a primary vibration mode in vibration occurred on the fixing bolt 9A, as illustrated in FIG. 4A, in addition to deflection reduction. In other words, deflection is reduced by the fact that the fixing bolt 9A includes the first large diameter part 14 correspondingly provided at a position at which an amplitude of the vibration in the primary mode becomes the largest. Note that, in FIG. 4A, the primary vibration mode is illustrated by an alternate long and short dash line, and the antinode is located at a position of an upward peak.

As described above, the fixing bolt 9A achieves the structure hard to be damaged, by deflection reduction function due to provision of the first large diameter part 14, in addition to the function of suppressing the stress concentration at the boundary between the head portion 11 and the columnar portion 12 and the boundary between the columnar portion 12 and the threaded portion 18 due to provision of the first small diameter parts 13 in the columnar portion 12.

Figure 2B:
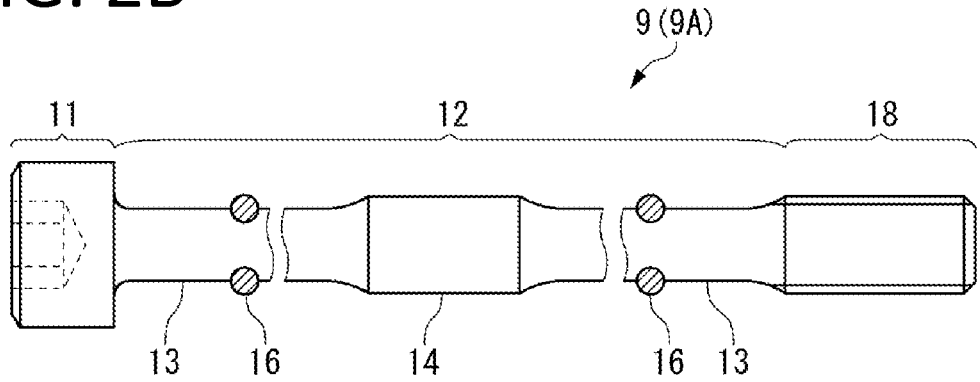
Figure 2C:
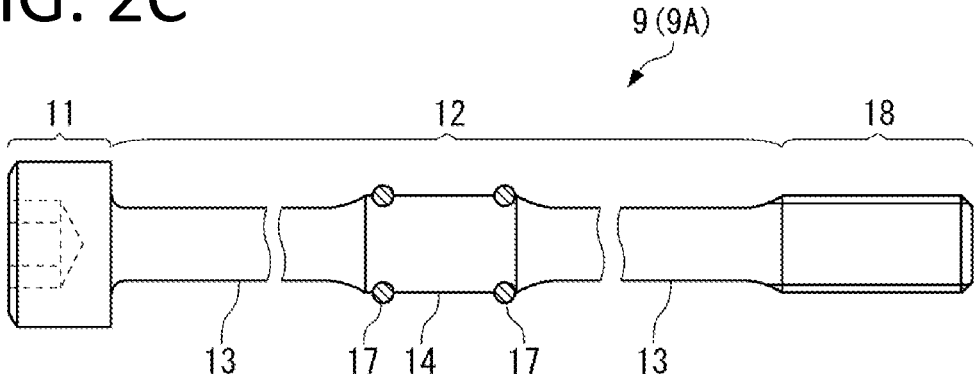

To make the fixing bolt 9A hard to be damaged, as illustrated in FIG. 2B and FIG. 2C, providing vibration dampers 16 or 17 on an outer periphery of the columnar portion 12 is effective. The vibration dampers 16 or 17 are interposed between the fixing bolt 9A and the wall surface defining the bolt insertion hole, thereby attenuating the vibration applied to the fixing bolt 9A. As illustrated in FIG. 2B and FIG. 2C, an O-ring may be used for the vibration dampers 16 and 17. The vibration dampers 16 and 17, however, are not limited to the O-ring, and various members that exert an attenuating function to damp vibration of the fixing bolt 9A, such as an annular resin member, may be used. In addition, the term "vibration damper" does not mean that the damper completely suppress vibration.

The vibration dampers 16 or 17 may be provided at any positions as long as exerting the function. For example, the vibration dampers 16 may be respectively provided at the first small diameter parts 13 as illustrated in FIG. 2B, or the vibration dampers 17 may be provided at the first large diameter part 14 as illustrated in FIG. 2C. Although not illustrated, the vibration dampers 16 and 17 may be respectively provided on the first small diameter parts 13 and the first large diameter part 14.

In the case where the vibration dampers 16 are respectively provided on the first small diameter parts 13 one by one as illustrated in FIG. 2B, the vibration dampers 16 are provided at respective positions that are equally distanced from the center of the columnar portion 12 in the axial direction, namely, at symmetrical positions about the center, in consideration of positional balance with respect to vibration.

Note that the example in which the first large diameter part 14 is disposed at the center in the axial direction is illustrated here; however, the first large diameter part 14 may not be disposed at the center in some cases for the structural reasons. In other words, a distance from the head portion 11 to the first large diameter part 14 may be different from a distance from the threaded portion 18 to the first large diameter part 14 in some cases. In this case, the first large diameter part 14 is not the symmetric reference. Accordingly, in this case, the vibration damper 16 is desirably provided at positions at the same ratio in each of the distance from the head portion 11 to the first large diameter part 14 and the distance from the threaded portion 18 to the first large diameter part 14. For example, when the distance from the head portion 11 to the first large diameter part 14 is denoted by L1, and the distance from the threaded portion 18 to the first large diameter part 14 is denoted by L2, if the damper 16 is disposed at a position of $1/2 \times L1$ between the head portion 11 and the first large diameter part 14, the damper 16 is disposed at a position of $1/2 \times L2$ between the threaded portion 18 and the first large diameter part 14.

Further, in the case where the vibration dampers 17 are provided on the first large diameter part 14, it is possible to dispose two vibration dampers 17 with an interval in the axial direction as illustrated in FIG. 2C. Also in this case, as with FIG. 2B, the vibration dampers 17 are provided at symmetrical positions about the center in the axial direction. In the case where the vibration dampers 17 are provided on the first large diameter part 14, however, only one vibration damper 17 may be provided at the center in the axial direction.

The diameter and the dimension in the axial direction of each of the first small diameter parts 13 and the first large diameter part 14 of the fixing bolt 9A are not uniquely determined, and are set according to the specification of the centrifugal compressor 10 in which the fixing bolt 9A is used.

Among them, when the dimension in the axial direction of the first large diameter part 14 is increased, moments at the boundary between the head portion 11 and the columnar portion 12 and at the boundary between the columnar portion 12 and the threaded portion 18 are increased. Therefore, the first large diameter part 14 has a minimum dimension that secures the above-described two functions of the first large diameter part 14. As an index, the dimension in the axial direction of the first large diameter part 14 is about 5% to about 15% of the dimension in the axial direction of the columnar portion 12.

Figure 3A:
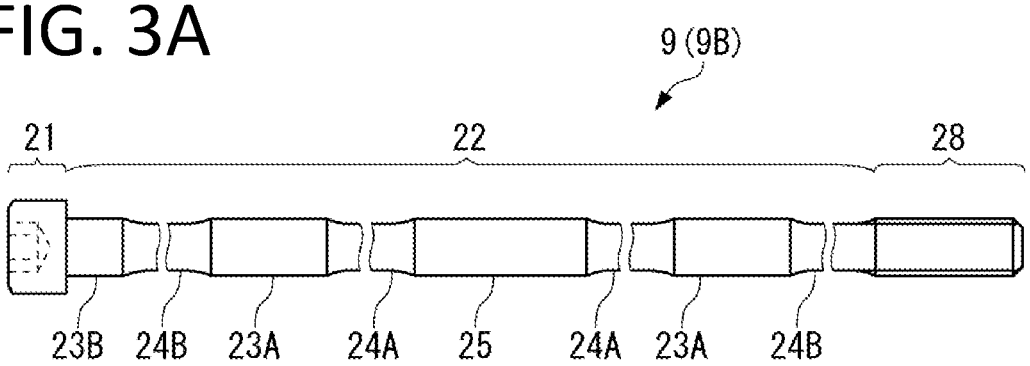
Figure 3B:
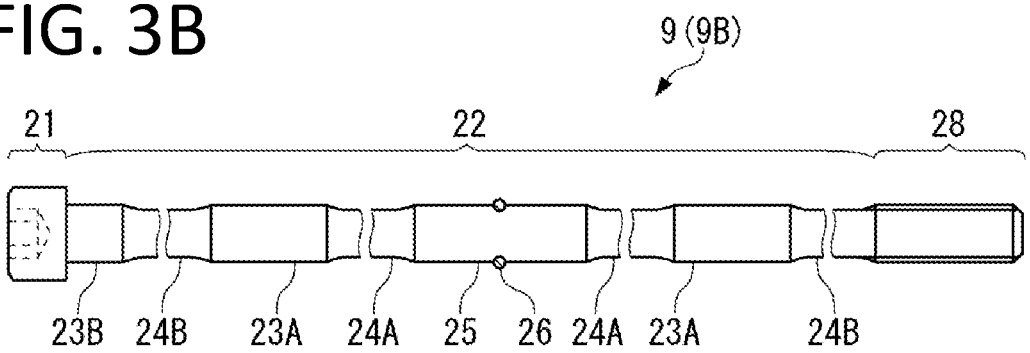
Figure 3C:
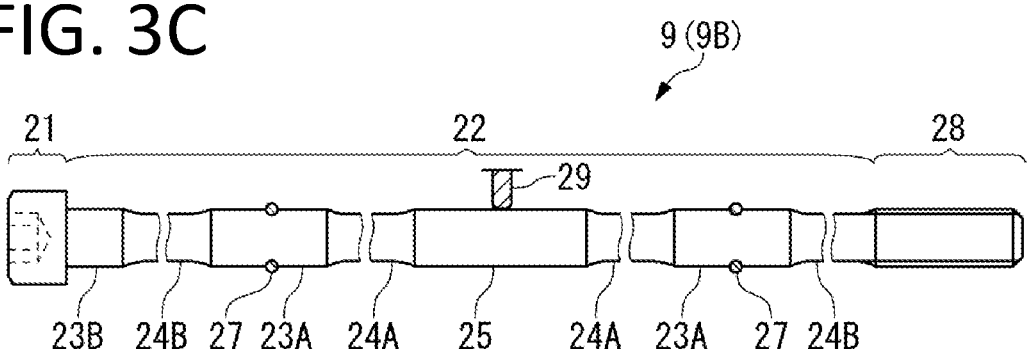

The fixing bolt 9A described above includes the first large diameter part 14 correspondingly provided at the position including the antinode of the primary vibration mode; however, as illustrated in FIGS. 3A to 3C, in one or more embodiments, second large diameter parts 23A and 23A may be correspondingly provided at positions including antinodes of a secondary vibration mode.

As illustrated in FIG. 3A, a fixing bolt 9B includes a head portion 21, a columnar portion 22 connected to the head portion 21, and a threaded portion 28 connected to the columnar portion 22. Also in the fixing bolt 9B, the columnar portion 22 is longer than the threaded portion 28. In the columnar portion 22, first small diameter parts 24A and 24A are disposed on both sides of a first large diameter part 25, and the second large diameter parts 23A and 23A that are respectively connected to the first small diameter parts 24A and 24A are provided. As described later, the second large diameter parts 23A and 23A respectively correspond to antinodes of the secondary vibration mode. Second small diameter parts 24B and 24B are respectively connected to the second large diameter parts 23A and 23A, and one second small diameter part 24B (on right side in drawing) is connected to the threaded portion 28. The other second small diameter part 24B (on left side in the drawing) is connected to a third large diameter part 23B, and the third large diameter part 23B is connected to the head portion 21.

Figure 4B:
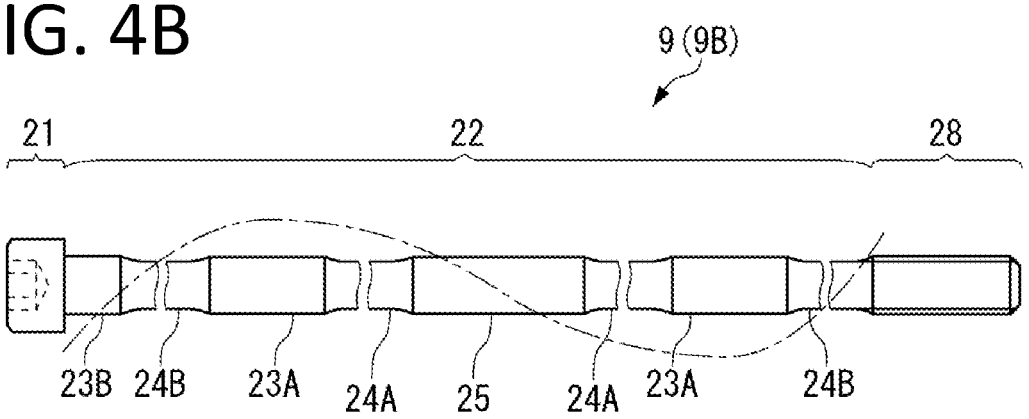
FIG. 4B is a diagram illustrating the fixing bolt of FIG. 3A and a secondary vibration mode by being superposed on each other.

As illustrated in FIG. 4B, in the fixing bolt 9B, each of the second large diameter parts 23A and 23A that are respectively provided on both sides of the first large diameter part 25 in the axial direction is provided at the position including the antinode of the secondary vibration mode. In other words, the fixing bolt 9B makes it possible to reduce vibration in both of the primary vibration mode and the secondary vibration mode.

Note that, in FIG. 4B, the secondary vibration mode is illustrated by an alternate long and short dash line, and the antinode is located at each of two positions of an upward peak and a downward peak.

In addition, in the fixing bolt 9B, the third large diameter part 23B is connected to the head portion 21, and the fixing bolt 9B is different from the fixing bolt 9B in which the first small diameter part 13 is connected to the head portion 11. This is because, even if stress concentration occurs on the boundary between the head portion 21 and the third large diameter part 23B, providing the third large diameter part 23B enhances the strength of the boundary to avoid damage. On the other hand, the second small diameter part 24B is connected to the third large diameter part 23B, which causes elastic deformation in the second small diameter part 24B to suppress stress concentration to the boundary between the head portion 21 and the third large diameter part 23B.

Figure 4C:
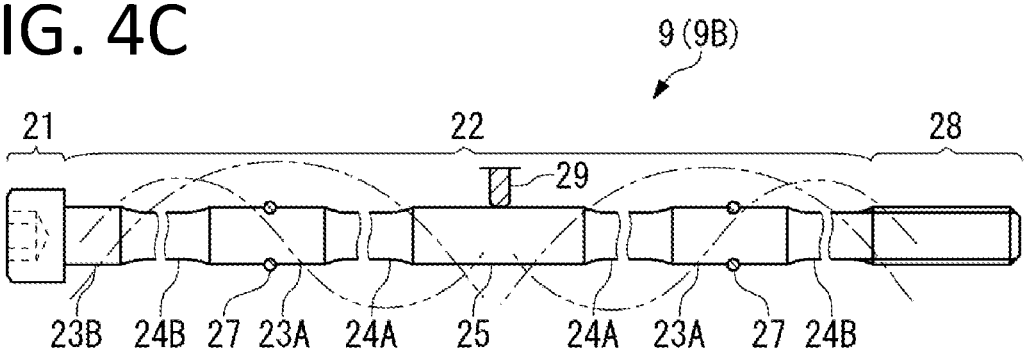

As illustrated in FIG. 3B and FIG. 3C, vibration dampers 26 or 27 may be provided also in the fixing bolt 9B. In FIG. 3B, one vibration damper 26 is provided at the center of the first large diameter part 25, and the vibration damper 26 is disposed corresponding to the antinode of the primary vibration mode. Further, in FIG. 3C, vibration dampers 26 are respectively disposed, one by one, at the centers in the axial direction of the second large diameter parts 23A and 23A that are disposed with an interval. In FIG. 3C, a restriction pin 29 that stops displacement of the fixing bolt 9B in the axial direction and a circumferential direction abuts on the center in the axial direction of the first large diameter part 25, and a vibration damper 27 is disposed in each of the second large diameter parts 23A and 23A while avoiding the restriction pin 29. FIG. 4C illustrates the vibration mode when the restriction pin 29 is provided. Note that, in FIG. 4C, the primary vibration mode is illustrated by an alternate long and short dash line, and the secondary vibration mode is illustrated by an alternate long and two short dashes line. As illustrated in FIG. 4C, the second large diameter parts 23A and 23A and the vibration dampers 27 and 27 are respectively provided at positions that suppress each of the primary vibration mode and the secondary vibration mode on both sides of the restriction pin 29 in the axial direction.

According to the above-described fixing bolt 9 (9A or 9B), the following effects are achievable.

Since the fixing bolt 9A includes the first large diameter part 14 corresponding to the antinode of the primary vibration mode, and includes the first small diameter parts 13 and 13, the strength of which is suppressed low, it is possible to reduce deflection of the columnar portion 12, and to suppress stress concentration to the boundary between the head portion 11 and the columnar portion 12 and to the boundary between the columnar portion 12 and the threaded portion 18. Since the fixing bolt 9B includes the second large diameter parts 23A and 23A that respectively correspond to the antinodes of the secondary vibration mode, it is possible to further reduce deflection of the columnar portion 22, in addition to achievement of the effects similar to those by the fixing bolt 9A. Accordingly, the fixing bolt 9A and the fixing bolt 9B make it possible to reduce occurrence of crack and fracture, and to improve vibration resistance.

Further, the fixing bolt 9 including the vibration dampers 16 or 17 and the fixing bolt 9 including the vibration dampers 26 or 27 make it possible to further improve the vibration resistance thereof due to the vibration attenuating function by the vibration dampers 16, 17, 26, or 27.

Although selected embodiments of the present invention are described above on the basis of the fixing bolt 9 and the fixing bolt 9 that are exemplary embodiments, the present invention is not limited to the embodiments.

In one or more embodiments, out of the through bolt 8 and the fixing bolt 9 that fasten the stationary member, the fixing bolt 9 has been described. As for the through bolt 8, the small diameter part and the large diameter part may be provided in the columnar portion and the large diameter part may correspond to the antinode of the vibration mode, as with the fixing bolt 9. In other words, the through bolt 8 and the fixing bolt 9 have been discriminated and described in one or more embodiments; however, both of the through bolt 8 and the fixing bolt 9 may include the large diameter part corresponding to the antinode of the vibration mode and the small diameter part, the strength of which is suppressed low.

Further, the number and the arrangement of each of the large diameter parts and the small diameter parts are optional. In other words, the optional number and the optional arrangement are also included in one or more embodiments of the present invention as long as one or more large diameter parts that correspond to the position of the antinode of the primary vibration mode of the fixing bolt 9, or to the position of the antinode of the primary vibration mode and the positions of the antinodes of the secondary vibration mode, and a plurality of small diameter parts each having a diameter smaller than the large diameter parts are included. Among them, the fixing bolt 9A illustrated in FIG. 2 and the fixing bolt 9B illustrated in FIG. 3 are forms of the present invention.

Moreover, the positions at which the vibration dampers 16, 17, 26, or 27 are provided are also optional, and one or more vibration dampers may be provided at any positions on the outer periphery of the columnar portion.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

REFERENCE SIGNS LIST

1 Rotary shaft
2 Impeller
3 Partition plate
3*d* Interstage flow path
4 Vehicle compartment
5 Inlet wall
5*i* Suction port
6 Outlet wall
6*o* Discharge port
7 Vehicle compartment cover
8 Bolt
9 Fixing bolt
9A Fixing bolt
9B Fixing bolt
10 Centrifugal compressor
11 Head portion
12 Columnar portion
13 First small diameter part
14 First large diameter part
18 Threaded portion
21 Head portion
22 Columnar portion
23A Second large diameter part
23B Third large diameter part
24A First small diameter part
24B Second small diameter part
25 First large diameter part
28 Threaded portion
29 Restriction pin

The invention claimed is:

1. A fixing bolt for use in a multistage centrifugal compressor, the bolt extending through and fixing a plurality of stationary members in the multistage centrifugal compressor, the bolt comprising:

a head portion;

a columnar portion connected to the head portion; and a threaded portion connected to the columnar portion, wherein the columnar portion includes a plurality of large diameter parts and a plurality of small diameter parts, each of the plurality of small diameter parts having a diameter smaller than each of the large diameter parts, the plurality of large diameter parts including a first large diameter part and second large diameter parts, the first large diameter part corresponding to a position of an antinode of a primary vibration mode of the fixing bolt, the second large diameter parts each corresponding to positions of antinodes of a secondary vibration mode of the fixing bolt, the plurality of small diameter parts includes first small diameter parts that are respectively disposed on both sides of the first large diameter part, the second large diameter parts are respectively connected to the first small diameter parts.

2. The fixing bolt according to claim 1, wherein the plurality of small diameter parts further includes second small diameter parts that are respectively connected to the second large diameter parts, and at least one of the second small diameter parts is connected to the head portion or the threaded portion.

3. The fixing bolt according to claim 1, wherein the plurality of small diameter parts further includes second small diameter parts that are respectively connected to the second large diameter parts, the plurality of large diameter parts further includes at least one third large diameter part, one side of the at least one third large diameter part is connected to at least one of the second small diameter parts, and the other side of the at least one third large diameter part is connected to the head portion or the threaded portion.

4. The fixing bolt according to claim 1, wherein the columnar portion further includes one or more vibration dampers on an outer periphery.

5. The fixing bolt according to claim 1, wherein at least one of the first large diameter part and the first small diameter part includes one or more vibration dampers.

6. The fixing bolt according to claim 1, wherein at least one of the second large diameter parts includes one or more vibration dampers.

7. The fixing bolt according to claim 2, wherein at least one of the second small diameter parts includes one or more vibration dampers.

8. A multistage centrifugal compressor comprising:

a fixing bolt that extends through and fixes a plurality of stationary members in the multistage centrifugal compressor, wherein the fixing bolt comprises:

a head portion;

a columnar portion connected to the head portion; and a threaded portion connected to the columnar portion, wherein the columnar portion includes a plurality of large diameter parts and a plurality of small diameter parts, each of the plurality of small diameter parts having a diameter smaller than each of the large diameter parts, the plurality of large diameter parts including a first large diameter part and second large diameter parts, the first large diameter part corresponding to a position of an antinode of a primary vibration mode of the fixing bolt, the second large diameter parts each corresponding to positions of antinodes of a secondary vibration mode of the fixing bolt, the plurality of small diameter parts includes first small diameter parts that are respectively disposed on both sides of the first large diameter part, the second large diameter parts are respectively connected to the first small diameter parts.

* * * * *